United States Patent [19]

Melanson et al.

[11] Patent Number: 4,570,046

[45] Date of Patent: Feb. 11, 1986

[54] METHOD OF PROCESSING PTC HEATER

[75] Inventors: Lionel J. Melanson; Frank Bucherati, both of Cumberland, Me.

[73] Assignee: GTE Products Corporation, Stamford, Conn.

[21] Appl. No.: 530,845

[22] Filed: Sep. 9, 1983

[51] Int. Cl.[4] ..... H01C 7/02; H01C 17/00

[52] U.S. Cl. ..... 219/68; 29/402.21; 29/575; 29/610 R; 219/381; 219/505; 338/225 D; 338/25

[58] Field of Search ..... 219/69 R, 68, 50, 504, 219/505, 383, 381, 384, 69 P; 29/575, 610 R, 402.01, 402.21; 338/225 D, 25

[56] References Cited

U.S. PATENT DOCUMENTS

| | | | |
|---|---|---|---|
| 2,494,029 | 1/1950 | Bertalan et al. | 219/68 |
| 2,501,481 | 3/1950 | Taggart | 219/155 |
| 2,777,042 | 1/1957 | Legg | 219/383 |
| 2,814,709 | 11/1957 | Walker | 219/200 |
| 3,098,917 | 7/1963 | Williams | 219/383 |
| 3,119,919 | 1/1964 | Pratt | 219/68 |
| 3,290,757 | 12/1966 | Tanck | 174/68.5 |
| 3,646,305 | 2/1972 | Schmidtke et al. | 219/50 |
| 3,842,489 | 10/1974 | Bustard | 219/50 |
| 3,930,304 | 1/1976 | Keller et al. | 338/195 |
| 4,107,515 | 8/1978 | Kulwicki | 219/381 |
| 4,180,901 | 1/1980 | Kulwicki | 338/333 |
| 4,189,509 | 2/1980 | Hill | 29/610 R |
| 4,189,700 | 2/1980 | Hill | 219/541 |
| 4,232,214 | 11/1980 | Shioi et al. | 219/381 |
| 4,264,888 | 4/1981 | Berg | 219/505 |
| 4,486,737 | 12/1984 | Ott | 219/505 |

OTHER PUBLICATIONS

"Printed Circuit Deletion Using Capacitor Discharge" by Funari et al., in IBM Technical Disclosure Bulletin, vol. 24, No. 12, May 1982, pp. 6383-6384.

*Primary Examiner*—C. L. Albritton
*Assistant Examiner*—Geoffrey S. Evans
*Attorney, Agent, or Firm*—James Theodosopoulos

[57] ABSTRACT

A PTC heater has passages therethrough through which a fluid can flow to be heated. The passages are separated from each other by thin walls of PTC material. Electrical current flow is in a direction normal to the thin walls. A short duration pulse of high electric current is applied to the heater in order to eliminate any electrical shorts between passages.

2 Claims, 2 Drawing Figures

METHOD OF PROCESSING PTC HEATER

This invention concerns PTC heaters for heating fluids, particularly gases. It is particularly concerned with such heaters that are somewhat sieve-like in shape, where the gas flows through perforations or passages in the heater and where the passages are defined and separated by thin walls of the PTC material. The electric current flow in the heater is through the thin walls in a direction normal thereto. Such heaters are shown in U.S. Pat. Nos. 4,107,515, 4,180,901, 4,189,509 and 4,189,700.

In order to provide proper current flow through the walls, the interior walls of the passages are coated with an electrically conductive material, usually a metal. About half of he passages are electrically connected together at one end or surface of the heater, and the other half are electrically connected together at the other surface of the heater. These electrical connections are often made in the same manner as are the eletrically conductive coatings on the interior walls of the passages such as by, for example, coating from a bath or metal spraying.

It is necessary that the two sets of passages not be inadvertently electrically connected together or shorted, which when it occurs, usually occurs at an end surface of the heater. Accordingly, a masking material is often used to prevent deposition of the electrically conductive material where it is not wanted, as shown in U.S. Pat. No. 4,189,700. Also, said patent discloses that abutments can be provided between passages at the ends of the heater. The ends of the abutments can then be abraded to remove any electrically conductive material that might be undesirably bridging the abutment.

A problem can occur, however, with such methods of trying to prevent or eliminate an undesirable electrical connection between the two sets of passages. If there is a fault in the heater during formation thereof, for example, an almost imperceptible crevice between adjacent passages at one end or across an abutment, a short between the passages can occur therein, in spite of masking material. Furthermore, abrading will not remove such a short. It is a purpose of this invention to solve such a problem.

This invention eliminates such undesirable electrical connections by applying a short duration pulse of high electric current, such as from a capacitor, between the two sets of passages. The pulse eliminates the undesirable electrical connections, whether they are low or high resistance shorts, by melting and/or vaporizing the shorting material.

Figure 1:
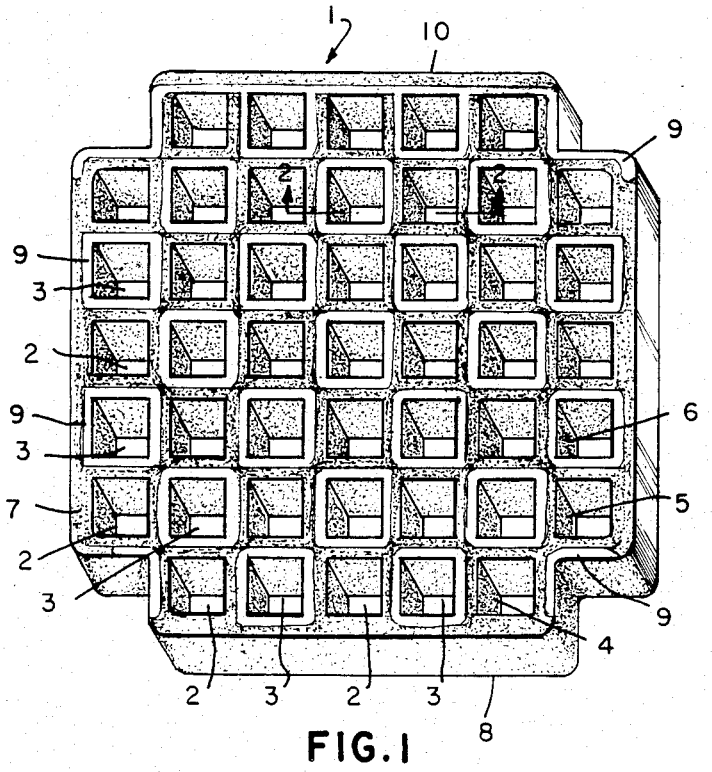
FIG. 1 is an elevational view of a PTC heater.
Figure 2:
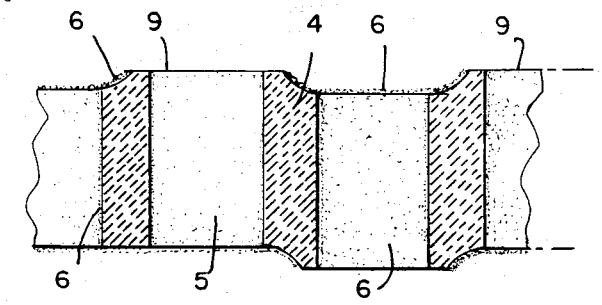
FIG. 2 is a sectional view along line 22 thereof.

PTC heater 1 has a plurality of passages 2 and 3 therethrough. Passages 2 and 3 are separated by thin walls 4.

Interior surfaces 5 of thin walls 4 are coated with an electrically conductive material 6. For passages 2, electrically conductive coating 6 extends to upper surface 7 of heater 1 and thence to electrode 8, which comprises one of the side walls of heater 1. Thus, all of the interior surfaces 5 of passages 2 are electrically connected to electrode 8 by means of electrically conductive coating 6. Surrounding passages 3 on upper surface 7 are raised abutments 9 on which there is no coating 6. Thus, passages 3 are not electrically connected to electrode 8 by coating 6. However, passages 3 are electrically connected to electrode 10, which is opposite electrode 8, by an electrically conductive coating on the bottom surface of heater 1 in the same manner as above. Thus, when a voltage is applied between electrodes 8 and 10, there will be current flow through all of the thin walls 4 surrounding passages 2 and 3, and the current flow will be in a direction normal to the thin walls.

In one example, heater 1 was made of barium titanate and was $1\frac{1}{4}$ inches by $1\frac{1}{4}$ inches by $\frac{1}{4}$ inch high. There were 24 passages 2 therethrough and 23 passages 3. Walls 4 were about 48 mils thick. The passages were about $\frac{1}{8}$ inch square. Coating 6 was arc sprayed aluminum. Prior to coating, a resist was deposited on raised abutments 9 to prevent adherence of arc sprayed aluminum thereto. The room temperature resistance of these heaters was about 2 ohms. Shorts between passages 2 and 3 would show up during an overvoltage test which consisted of applying 24 volts DC between electrodes 8 and 10. In the prior art, the procedure for removing such shorts involved examination of the heater, sometimes with a magnifying glass, to locate the short and then scraping away the shorting material with a sharp edged metal tool.

We eliminate the shorting material by means of a short duration pulse of high electrical current from, for example, an electrically charged capacitor. In the heater described, a 1000 microfarad capacitor charged to 60 or 70 volts was used. The capacitor was connected across electrodes 8 and 10. When a short was present, the pulse vaporized and/or melted the shorting material, to the accompaniment of a visible arc and an audible noise. Any residue of vaporized and/or melted shorting material could be easily brushed away.

We claim:

1. In the manufacture of a PTC heater having passages therethrough, the passages being separated from each other by thin walls of PTC material, where electrical current flow during normal operation of the heater is in a direction normal to the thin walls, the process of subjecting the heater to a short duration pulse of high electric current in order to eliminate any electrical shorts between passages.

2. The process of claim 1 wherein the pulse is delivered from an electrically charged capacitor.

* * * * *